United States Patent [19]

Aycox et al.

[11] Patent Number: 4,896,142

[45] Date of Patent: Jan. 23, 1990

[54] MOISTURE DETECTION SYSTEM FOR CARPET CLEANING APPARATUS

[76] Inventors: Dale G. Aycox, Rte. 3, Box 335, Space 11, Gainesville, Tex. 76240; Kenneth Aycox, R.R. 1, Box 3940, Rogers, Ark. 72756

[21] Appl. No.: 40,376

[22] Filed: Apr. 16, 1987

[51] Int. Cl.[4] ..... G08B 21/00

[52] U.S. Cl. ..... 340/604; 340/616; 417/36; 73/304 R

[58] Field of Search ..... 340/604, 605, 620, 616; 73/304 R; 417/36, 40, 12

[56] References Cited

U.S. PATENT DOCUMENTS

| | | | |
|---|---|---|---|
| 4,263,587 | 4/1981 | John | 73/304 R X |
| 4,374,379 | 2/1983 | Dennison, Jr. | 340/605 X |
| 4,418,712 | 12/1983 | Braley | 340/604 X |

*Primary Examiner*—Joseph A. Orsino
*Assistant Examiner*—Jeffery A. Hofsass

[57] ABSTRACT

A moisture detection device that is responsive to moisture or foam in the vacuum port of a water extraction unit, which creates a circuit break in the electrical power to the extraction unit. The device includes two conductors mounted in the vacuum port of an extraction unit, a monitoring system, by pass switch, and delay for fool proof detection of moisture overflow from the recovery tank of water extractors.

3 Claims, 2 Drawing Sheets

MOISTURE DETECTION SYSTEM FOR CARPET CLEANING APPARATUS

BACKGROUND OF THE INVENTION

1. Field of the Invention

The present invention relates to a device that will detect moisture foam or water in the vacuum port of water extraction units to prevent overflow of moisture foam or water into vacuum pumps of extractors used in carpet cleaning systems.

2. Description of the Prior Art

Prior art of moisture detection has application such as shown in U.S. Pat. Nos. 4,539,559, 4,502,044, 4,464,582 and other applications that apply to bed wetting such as shown in U.S. Pat. Nos. 4,357,503 and 4,539,559. The present invention is intended to be a fail safe detector of moisture in the vacuum port of water extractors.

Moisture overflow has long been a problem in the field water of extraction. Carpet cleaners, floor cleaners, and others who extract water by the use of the vacuum extraction method have long recognized the need for improvements in the now used vacuum float systems mounted in the recovery tank. Because of failures of malfunction of the float used in recovery tanks to detect light moisture or foam entering the vacuum pump damage occurs such as rust, corrosion and wear due to moisture and/or foam in the vacuum pump.

The present invention is a fail safe method to detect moisture overflow which is necessary for the prevention of damage to the vacuum pump.

SUMMARY

The present invention solves the problem of overflow from the recovery tank by means of electronic detection of moisture foam or water in the vacuum port between the recovery tank and the vacuum pump. When detectors become moist, or more particularly the conduction path between the sensor elements reaches a predetermined conductive state, the power source is automatically cut off to the water extraction unit. This quick detection not only keeps the vacuum pump from being damaged by dirt, rust, wear, etc., but also prevents overflow out of the vacuum pump exhaust which can cause damage to surrounding objects.

It is an object of the present invention to have instant, constant, and accurate monitoring of moisture level in the vacuum port.

It is another object of the present invention that a predetermined moisture level including foam and water is detected before extractor components are damaged.

Another object of the present invention is to provide an efficient, low cost moisture detection system.

DESCRIPTION OF THE INVENTION

DESCRIPTION OF THE PREFERRED EMBODIMENT

Figure 1:
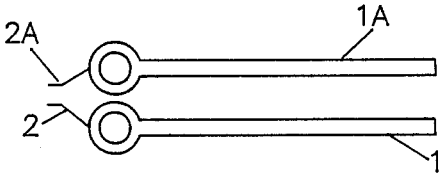
FIG. 1 illustrates a two element moisture sensor.

More specifically, conductors 1 and 1A illustrated in FIG. 1 form a moisture sensor that is installed in the vacuum port of a water extractor system between the recovery tank and the extractor pump. The two conductors 1 and 1A are closely spaced so that water, water vapor or foam between the conductors create an electrical conductive path between the two conductors. Sensor conductor 1 and 1A are electrically connected to the moisture detection control circuit illustrated in FIG. 2 by wires 2 and 2A.

Figure 2:
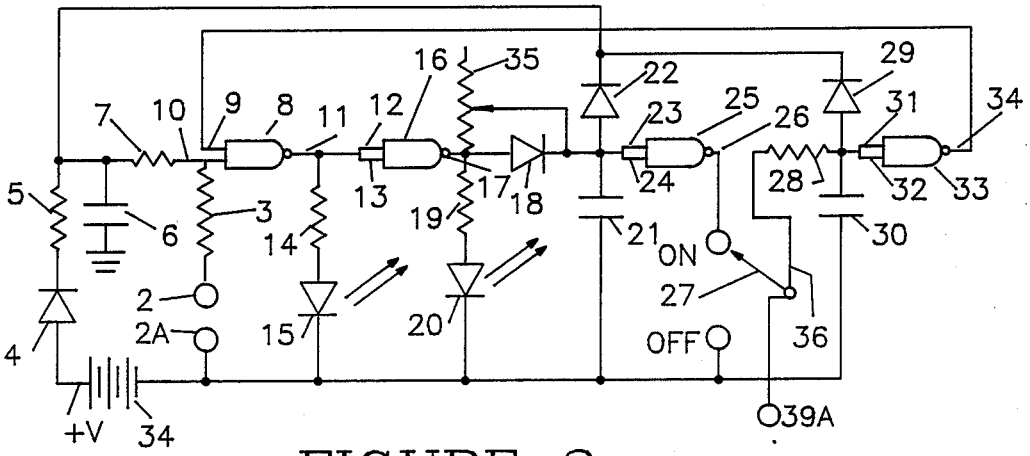
FIG. 2 is a schematic diagram of a moisture detector circuit including monitoring lights, a delay, and locked loop.

In the control shown in FIG. 2, diode 4 is to prevent damage to the detector circuit if the polarity of battery 34 is reversed. Resistors 5 and capacitor 6 are for surge protection for the CMOS Chip which consists of four CMOS gates 8, 16, 25 and 33. The control circuit includes a detector circuit which detects current flow between the sensor elements 1 and 1A. The detector circuit consists of gate 8, resistors 7 and 3 and a battery with the potential of +V volts (usually 12 volts). The detector circuit has its input connected to sensor elements 1 and 1A by wires 2 and 2A. The detector is designed to detect the flow of current between sensor elememts 1 and 1A thus turning on gate 8 when the conductors 1 and 1A become moist because of foam or water causing conduction between the elements 1 and 1A.

An auxiliary 12V D.C. power supply can be used in the place of battery 34. When the conductors are "dry" the detector circuit is in the "dry state" thus the voltage at inputs 9 and 10 of gate 8 are almost at +V volts (hereinafter generally referred to as "high" or in a "high state") and the output lead 11 of gate 8 and the inputs 12 and 13 of gage 16 are at nearly zero volts or ground potential (hereinafter sometimes referred to "low" or in a "low state") The output lead 17 of gate 16 and the inputs 23 and 24 of gate 25 are high. Thus diode 20, which is a green light emitting diode, will conduct through resistor 19 indicating that the conductors are dry. Diode 18, potentiometer 35 and capacitor 21 are all part of a delay circuit and are further discussed below. When output 17 of gate 16 is high, output 26 of gate 25 and inputs 31 and 32 of gate 33 are low, and output 34 of gate 33 and input 9 of gate 8 are high.

In the "wet" state, sensor elements 1 and 1A are moist, a conductive path is established between the two elements permitting current to flow between them. Resistor 7, having a high resistance (for example about 1 meg ohm) will cause the voltage at the input 10, gate 8, to drop from high (+V volts) to almost zero volts (low). This change causes output lead 11, gate 8, and inputs 12 and 13 of gate 16 to change from low to high. Diode 15, a red light emitting diode, will conduct through resistor 14, indicating that the conductors are "wet". When inputs 12 and 13 of gate 16 are low then output lead 17 of gate 16 will change from high to low. Diode 20, the green light emitting diode, which indicates that the conductors are "dry" will be turned off.

To prevent a momentary "wet" condition of the sensor elements 1 and 1A from shuting down the water extractor, a delay is used in the control circuit to ensure that the "wet" condition of the sensor elements is a condition to be detected and not just a momentary condition. The delay consists of potentiometer 35, diode 18 and capacitor 21. The function of the delay is to set the amount of time it takes to "shut down" the water extractor and at the same time force gate 33 to "lock" the detector circuit after the conductors become moist. When the output 17 of gate 16 changes to low, capacitor 21 begins to discharge through potentiometer 35.

The time constant depends on the value of capacitor 21 and the resistance setting of potentiometer 35. The purpose of diode 18 is to quickly recharge capacitor 21 should the conductors become dry. As capacitor 21 discharges, and the voltage on input leads 23 and 24 of gate 25 goes low, output lead 26 of gate 25 changes from low to high. In the operational mode, when switch 27 is in the on position, leads 26 and 36 will be electrically connected through the switch. The primary function of gate 33 is to "lock" or "hold" output 11 of gate 8 high. This occurs when inputs 31 and 32 of gate 33 changes from low to high.

This will cause output 34 of gate 33 to change from high to low. Output lead 34 of gate 33 is electrically connected to input 9 of gate 8. Thus, input 9 of gate 8 will also be low. This will "lock" or "hold" output 11 of gate 8 high. Thus all outputs of all gates will be are in a "locked state". An advantage to having a "locked state" is a keep power from being supplied to the water extractor after it has been turned off, and until released by switch 27. By this means power cannot be applied to the water extractor until it is intentionally reset by switch 27.

The function of resistor and capacitor 30 is to prevent the detector circuit from coming on in the "locked state" when power is turned "on" to the moisture detection control circuit. This is accomplished by resistor 28 limiting the current to capacitor 30, thus holding inputs 31 and 32 of gate 33 low. This will cause output lead 34 of gate 33 and input lead 9 of gate 8 to be high and output 11 or gate 8 be low. Therefore, the moisture detection device will come on in the "unlocked state" when the power is turned on.

Figure 3:
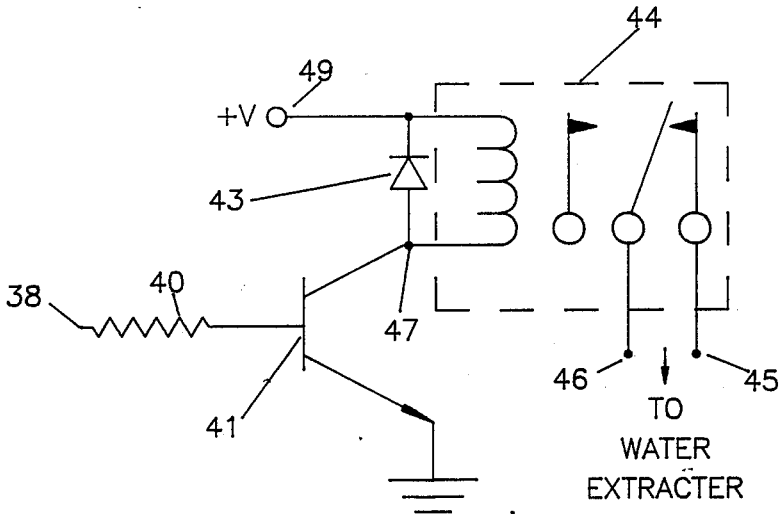
FIG. 3 is a schematic diagram of a "shut down" circuit.

The "shutdown" circuit in FIG. 3 removes power from the water extractor when the detector circuit goes in to the "locked state". In the "locked state", lead 36 (FIG. 2) and lead 39 (FIG. 3), which are connected together, will be high. Lead 39 connects to the control circuit of FIG. 2 at terminal point 39A. Coil lead 48 of relay 44 is connected to +V volts and coil lead 47 or relay 44 is connected to the collector of transistor 41. Current flow through resistor 40 will cause transistor 41 to conduct and relay 44 will activate. This will cause the electrically connected circuit between leads 45 and 46, or relay 44, to open, thus removing the power to the water extractor.

Diode 43 is used to protect relay 44 from voltage surges. The primary function of the switch 27 is to restore current to the water extractor by releasing relay 44, and at the same time allowing monitoring of panel lights to determine if sensor elements 1 and 1A are "wet" or "dry". This is accomplished by moving switch 27 to the "off" position. When switch 27 is moved to the "off" position, it will disconnect output lead 26 of gate 25 from lead 36, and also electrically connect lead 36, to ground through switch 27. Lead 39 (FIG. 3), connected to lead 36 will also be connected to ground through switch 27. This causes transistor 41 to stop conducting, releasing relay 44, thereby restoring power to the water extractor through leads 45 and 46. Switch 27, in the "off" position also resets or "unlocks" the detector circuit returning the detector to an operational state. Resetting is accomplished by grounding inputs 31 and 32 or gate 33 through resistor 28 and switch 27. This causes output 34 or gate 33 and input 9 of gate 8 to change from the low to high state, unlocking the monitoring system and restoring the monitoring functions of light emitting diodes 15 and 20. Diodes 22 and 29 keep the voltage on inputs 23 and 24 of gate 25 and inputs 31 and 32 of gate 33 from exceeding +V volts, preventing damage to the CMOS Chip.

Figure 4:
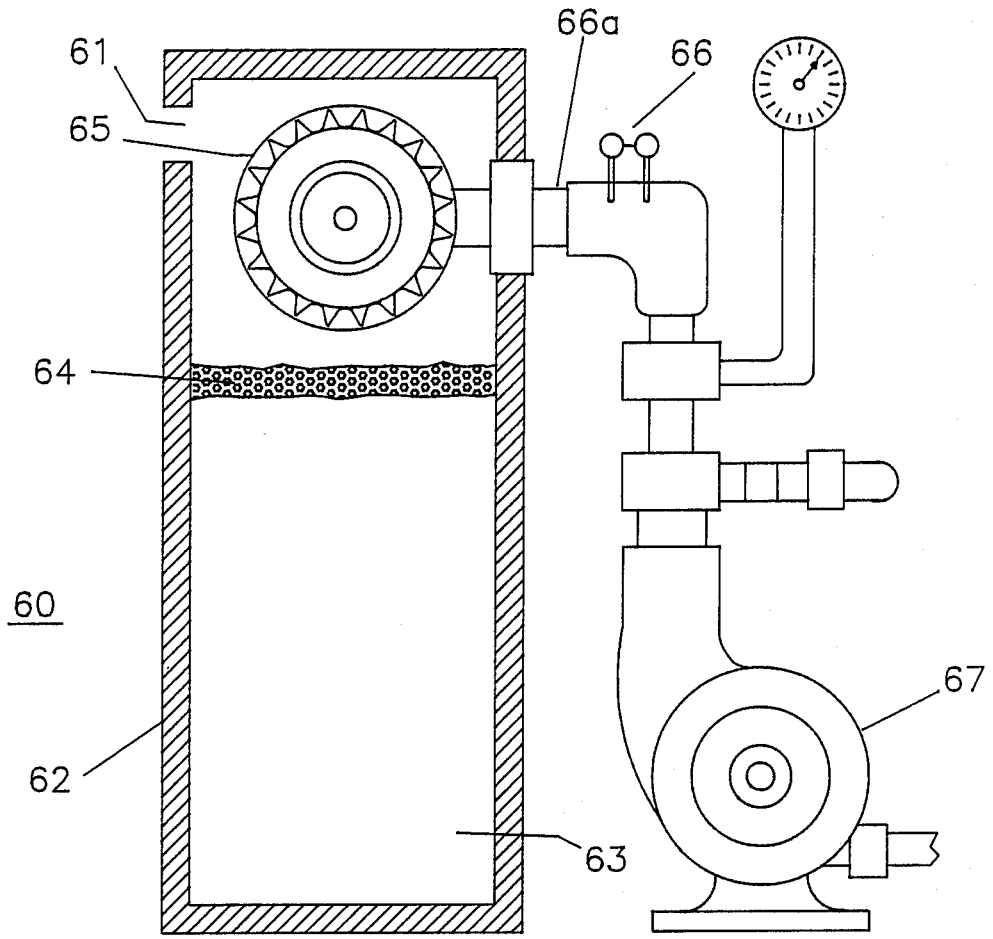
FIG. 4 illustrates a carpet cleaning system having a moisture, water and foam detectors in the vacuum port.

FIG. 4 illustrates a carpet cleaning system having a moisture, foam, and water detector in the vacuum port of the vacuum pump. System 60 includes a water recovery tank 62 into which water 63 and foam 64 is drawn into tank 62 by vacuum motor 67. The vacuum is drawn through the inlet 61, the heavier water and foam falls in to tank 62 while the vacuum air goes through filter 65 and into the vacuum pump past sensor 66, which is in the vacuum port **66*a*. In the event the water and foam level is high enough to be drawn into the vacuum port 66*a*, then sensor 66** will detect the moisture cause by the foam or water and turn the vacuum motor off to prevent the drawing of foam or water through the vacuum motor. A common shut off system using a float to detect water level is not sufficient in carpet cleaning systems since the float will not be elevated by foam, thereby allowing foam to enter the vacuum motor prior to the vacuum motor being turned off by the rise in water level.

What is claimed is:

1. A water extraction system including means for detecting moisture, foam or water flowing into a vacuum water pump, comprising a water vacuum pump, moisture recovery tank, a moisture sensor for detecting at least one of moisture, foam or water, a control unit and means for removing power from the vacuum pump when moisture, foam or water is detected flowing into the vacuum pump, aid water vacuum pump drawing water and moisture into said moisture recovery tank, said sensor being located between said water recovery tank and the vacuum pump, said sensor including two parallel conducting elements closely spaced so that the moisture, foam or water content between or across the two elements affects the conductance between the two conducting elements, the control unit including a detector circuit for detecting a change of conductance between the two sensor conducting elements, the control unit also including two indicating lights, one of which is on when there is no conductance between parallel conducting elements and the other indicating light is on when the is conductance between the parallel conducting elements, the control unit also including a time delay circuit to prevent premature removal of power from the vacuum pump and a lock loop to ensure that the power is not reapplied to the vacuum pump once power is removed.

2. The system according to claim 1, characterized by a manual reset switch which will restore power to the extractor unit and unlock the control unit to a state in which a change of condition of the moisture sensor can be monitored by the indicating lights.

3. The system according to claim 1, characterized in that the time delay circuit prevents a momentary conductance between the two elements of the moisture sensor from removing power from the vacuum pump.

* * * * *